United States Patent [19]

Beisler

[11] Patent Number: 4,694,767

[45] Date of Patent: Sep. 22, 1987

[54] DEVICE FOR TRANSFERRING A FABRIC STRIP FROM A DEPOSIT STATION

[75] Inventor: Alfons Beisler, Goldbach, Fed. Rep. of Germany

[73] Assignee: Beisler GmbH, Fed. Rep. of Germany

[21] Appl. No.: 922,744

[22] Filed: Oct. 24, 1986

[30] Foreign Application Priority Data

Nov. 7, 1985 [DE] Fed. Rep. of Germany ..... 3539551

[51] Int. Cl.[4] ..... D05B 27/00

[52] U.S. Cl. ..... 112/303; 112/147

[58] Field of Search ..... 112/303, 147, 148, 143, 112/152, 153, 150

[56] References Cited

U.S. PATENT DOCUMENTS 3,277,851 10/1966 Dobner et al. ..... 112/147 X
3,381,640 5/1968 Davidson ..... 112/150 X
3,747,544 7/1973 Nicolay et al. .
3,859,937 1/1975 Fenzl ..... 112/147 X
4,068,603 1/1978 Arbter ..... 112/147 X
4,281,606 8/1981 Beisler .

*Primary Examiner*—H. Hampton Hunter
*Attorney, Agent, or Firm*—Harness, Dickey & Pierce

[57] ABSTRACT

Apparatus for transferring a fabric strip 12 from a deposit station 10 to a support base 16 includes a plate 24 having a stop ledge 28 abutting an end of the fabric strip 12. A bar 34 projects through an opening 30 in plate 24 to create a fold in the fabric strip 12. A thin plate 66 retracts against a ledge 52 to grasp the fabric strip 12. Then, the transfer clamp 14 is rotated into a position such that the plate 66 lies flush with the support base 16. The transfer clamp releases the folded fabric strip 12 in a position where it is then fed into the sewing machine 22 together with the fabric piece 18 when they are sewn together.

11 Claims, 5 Drawing Figures

DEVICE FOR TRANSFERRING A FABRIC STRIP FROM A DEPOSIT STATION

BACKGROUND AND SUMMARY OF THE INVENTION

The invention concerns a device for transference of a fabric strip from a deposit station to a support base, according to the main idea in claim 1.

A device of this sort is established, for example, in U.S. Pat. No. 4,281,606. The established device serves to transfer a flap of fabric from the deposit station to a fabric clamp. This fabric clamp secures the flap and the fabric (onto which the flap is to be sewn) to the sewing machine table. According to the established device, the transfer clamp seizes the end of the fabric strip. The strip's end projects over the edge of the support plate. The transfer clamp then pulls the end of the fabric strip with a swinging movement under and through a flap clamp. The flap clamp is attached to the fabric clamp. Now the fabric strip can be held securely by the flap clamp on the fabric clamp. A device similar to the aforementioned device, for transference of a piping strip to a folded device, is disclosed in U.S. Pat. No. 3,747,544. With this device, a transfer clamp, which is adjustable, seizes the end of the piping strip as it projects from the support plate. The device then deposits the piping strip's end into a folding device.

In both cases, the fabric strip is transfered unchanged from the deposit station to the support base. However, there are cases in which the fabric strip must be folded before being placed onto the support base, or onto the fabric. For example, it is undesirable to simply stitch the fabric strips forming a pocket trim on the actual pocket seam in a pair of pants. Otherwise, the person wearing the pants can easily catch his hand on the threads of this seam and inadvertantly rip the seam out. Instead, the pocket trim in the seam area should be first folded and then sewn in along with the actual pocket. For this process, the seamstress must first fold the fabric strips (the trim) and lay them in their folded condition onto the actual pocket. Both pieces must then be fed by hand through the sewing machine. This process necessitates a considerable amount of time and care, because, due to the narrowness of the folded strips, they can easily become unfolded. Also, the seam must run very close to the fold.

It is an object of this invention to provide a device of the aforementioned sort which is able to take a fabric strip from the deposit station and lay it, in a folded condition, onto the support base.

As it lies on the stop ledge on the support plate, the fabric strip arches up almost imperceptibly over the folding bar. The arched segment of the strip projects into the opening of the transfer clamp. If this transfer clamp is closed, the fabric strip will be folded and held securely in the folded position. In this position of the transfer clamp, the fabric strip cannot be deposited without the danger of it unfolding again as soon as the clamp is opened. For this reason, the transfer clamp will be swung, so that the area where the fabric strip is affixed between the clamp ledges is no longer vertical to the support's plane, but instead is situated horizontal to this plane. This will occur either before or during the transition of the transfer clamp from its receiving position to its delivery position. In this horizontal position, the fabric strip can be layed flat onto the support base. The strip can also, for example, be accepted by a fabric clamp which leads the strip, together with the fabric onto which the strip will be sewn, to the sewing station.

Here it is advantageous if the clamping ledges (which work together to hold the segment of fabric strip and which face the support base in the delivery position) are fashioned from thin plates. This way, there will be only an unnoticeable gradation between the support base and the clamp ledge which lies on this base. The fabric, even in its folded condition, can then be laid almost completely level on the support base.

If only one of the clamp ledges is moved to hold the fabric, while the other clamp ledge rests across from the support plate, then it is advisable to mount the folding bar so it is adjustable against resilience. The folding bar should be adjustable vertically and also parallel to the support plane of the support plate. Otherwise, it would be necessary to place the clamp ledge (which is resting during the clamping process) on the support plate exactly next to the folding bar while placement of the transfer clamp occurs. This must be done in order to be able to subsequently close the clamp. By means of the resilient mounting of the folding bar, it would be nevertheless taken along as the clamp closes and slid out from between the folded fabric as the transfer clamp lifts from the support plate. Then it will turn by means of its resilience again back to its initial position. Because of the folding bar's movement allowance, no essential adjustment problems arise in adjusting the receiving position of the transfer clamp relative to the folding bar.

In order to adjust to the width of the end segments that will be seized by the transfer clamp, the folding bar may be so arranged, that it is vertically adjustable to the support plane of the support plate. The folding bar, fashioned, for example, from a steel plate, is appropriately screwed onto its mounting. The screws penetrate the folding bar through slots, so that the bar may be adjusted.

To enable lying another piece of fabric (upon which the transferred fabric strip will be placed) ready under the support plate, it is advisable to manufacture the support plate from a transparent material. In this way, the laborer's view is unobstructed while he arranges the fabric.

In the preferred construction, the clamp ledge is mounted on a bow. The bow is on a pivotal axle. Here, the transfer clamp is adjustable by means of a cylinder. This cylinder seizes both a piece attached to the bow and this clamp ledge. The other clamp ledge is appropriately led to the first clamp ledge which is attached to the bow. This second clamp ledge is adjustable, just as the transfer clamp, to open and close. This adjustment is achieved by a second cylinder, which is attached to both clamp ledges. Therefore, the clamp ledges are moved straight across from each other as the transfer clamp opens and closes.

Adjustment of the transfer clamp from the receiving position to the delivery position, and vice versa, can be achieved as follows:

The bow (adjustable to height) is led to a frame. The bow is adjustable by a third cylinder which operates between the frame and the bow. The frame, on its mount, is pivotably mounted to an axle parallel to the support plate. This is adjustable by means of a fourth cylinder which operates between the mount and the frame. Hereby, the support plate (relative to the support base) is tilted to an angle corresponding to the pivotal angle of the frame. After closing the transfer clamp in the deposit station, the transfer clamp will then, for example, be lifted from the support plate and subsequently be swung back away. As a result, the frame on its mount will be swung far enough so that the transfer clamp can be lowered going by the support plate onto the support base. The fabric strip lying on the support base can then, for example, be clamped onto the support base, in its folded condition, by a fabric clamp. Hereby the transfer clamp can be opened and lifted from the support base.

With the device described above, it is possible to execute a problem-free and absolutely exact deposit of a fabric strip (in its folded condition) to a support base. The laborer must simply arrange the first piece of fabric on the support plate, and then lay the fabric strip (which is to lie on the first piece of fabric) onto the support plate. The folding and transfer of the fabric strip, as well as the sewing of both fabric pieces, result automatically from there.

BRIEF DESCRIPTION OF THE DRAWINGS

Further characteristics and advantages of the invention are given in the following description. The description, in addition to the attached drawings of a sample construction, will clarify the invention.

DESCRIPTION OF THE PREFERRED EMBODIMENT

Figure 1:
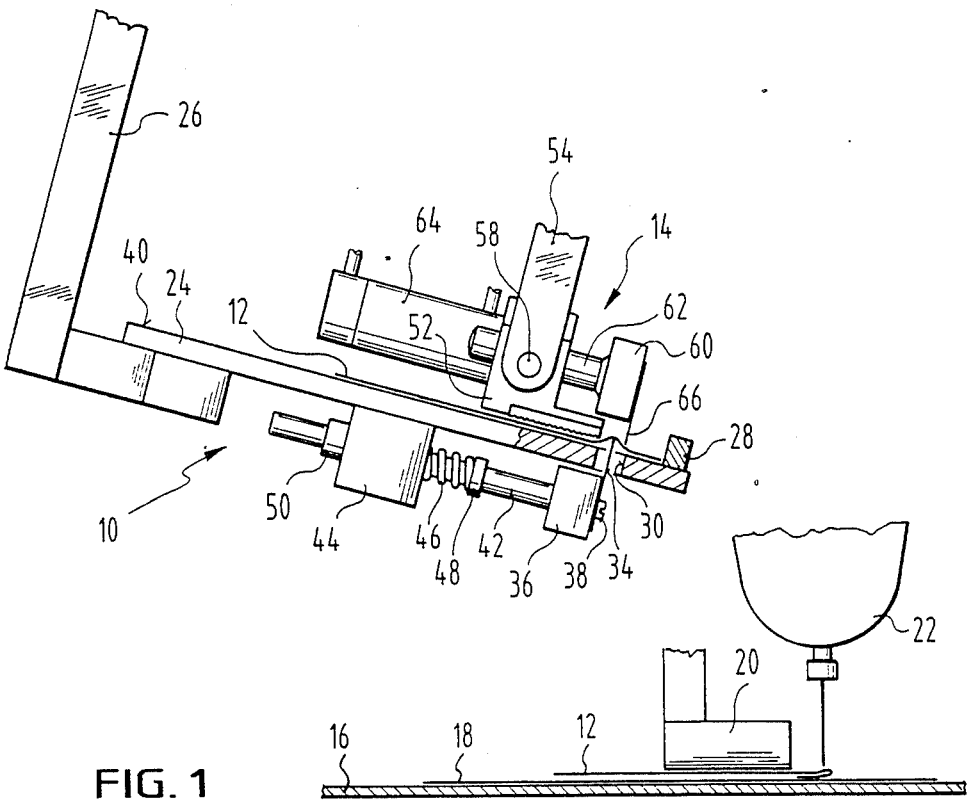
FIG. 1 shows a partially schematic, partially intersecting view of the deposit station and the transfer clamp in association to a sewing machine.

In FIG. 1, one can recognize the deposit station, generally referred to here as 10, for the fabric strip 12. This fabric strip 12 shall be folded by the transfer clamp, generally referred to here as 14, and layed in its folded condition on another fabric piece 18. This fabric piece 18 lies on the sewing machine table 16. The fabric strip 12 will subsequently be led through together with the fabric piece 18 under the sewing machine 22 by means of a fabric clamp 20. Here, the strip 12 may be sewn onto the fabric piece 18.

The deposit station includes a support plate 24 which is preferrably made of a transparent material. This is so the laborer's view of the support base (that is, the sewing machine table 16 or the fabric piece 18) is unobstructed. The support plate 24 is tilted across the sewing machine table 16, and held over a suspension bow 26 on a mount. This mount is stationary on the sewing machine table.

Figure 5:
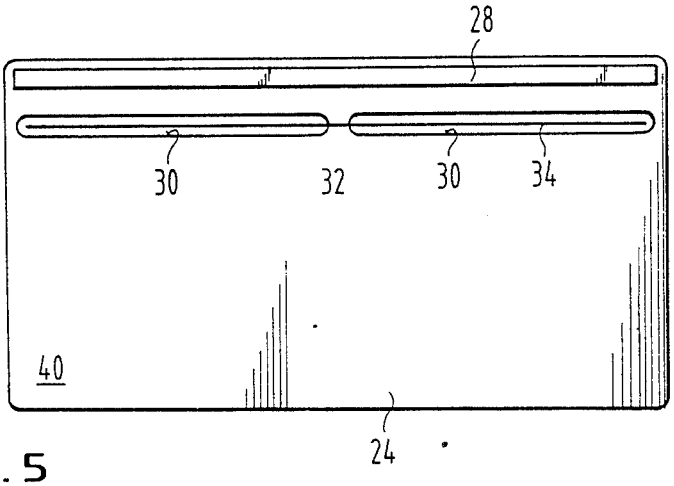
FIG. 5 shows a head-on view of the support plate.

The support plate 24 carries an upwardly protruding stop ledge 28 on its lower edge. A small distance away from the stop ledge 28, the support plate 24 has a slit 30, which runs parallel to the ledge 28. This slit 30 may be interrupted in the center by a narrow bridge 32, as seen in FIG. 5. The folding bar 34, in the form of a thin steel plate, projects through this slit 30. The bridge 32 enters a suitable recess in the folding bar 34. This folding bar 34 is fastened by screws 38 to a ledge 36 located under the support plate 24. The bar 34 is fastened in such a way that it is vertically adjustable to the support plate 24. This is so the device can be adjusted in order for the folding bar 34 to project over the plane 40 of the support plate 24.

The ledge 36 is led to a bar 44 by a bolt 42, which is arranged parallel to the support plate 24. This bar 44 is fastened to the underside of the support plate. THE ledge 36 is harnessed in its position away from the bar 44 by means of the springs 46. The springs 46 surround the bolts 42. On one side, the springs are supported by the bar 44 and on the other side, the collar 48 of each bolt 42 braces them. Another collar 50 on the backside of the bar 44 prevents the bolts 42 from slipping out of the bar 44. In this way, the folding bar 34 (with its slits 30) is also free to be vertically adjusted towards the stop ledge 28, against the tension of the springs 46.

The transfer clamp includes an angle-shaped clamp ledge 52, according to FIGS. 1 through 4. This clamp ledge 52 is flexibly attached by its hinged piece to a U-shank 54 of a U-shaped bow 56. This way the clamp ledge 52 is mounted around the pivotal axle 58 on the bow 56. A second clamp ledge 60, which co-operates with the other shank of the clamp ledge 52, is mounted on the clamp ledge 52 with bolts 62. A pneumatically operated cylinder 64 is attached to the first clamp ledge 52. The piston rod (not shown here) of the cylinder 64 is connected to the clamp ledge 60. This way the cylinder 64 can operate the opening and closing of the transfer clamp 14. Here it is possible to fashion the cylinder 64 either as a double-operating one, or to harness the transfer clamp 14 in one of its positions. At the same time, the cylinder 64 may be adjusted to the other position.

The clamping plane of the clamp ledge 60, which cooperates with the clamp ledge 52, is located on a thin steel plate 66, which is attached immobily to the ledge 60. The purpose of this will be clarified later in more detail.

Figure 2:
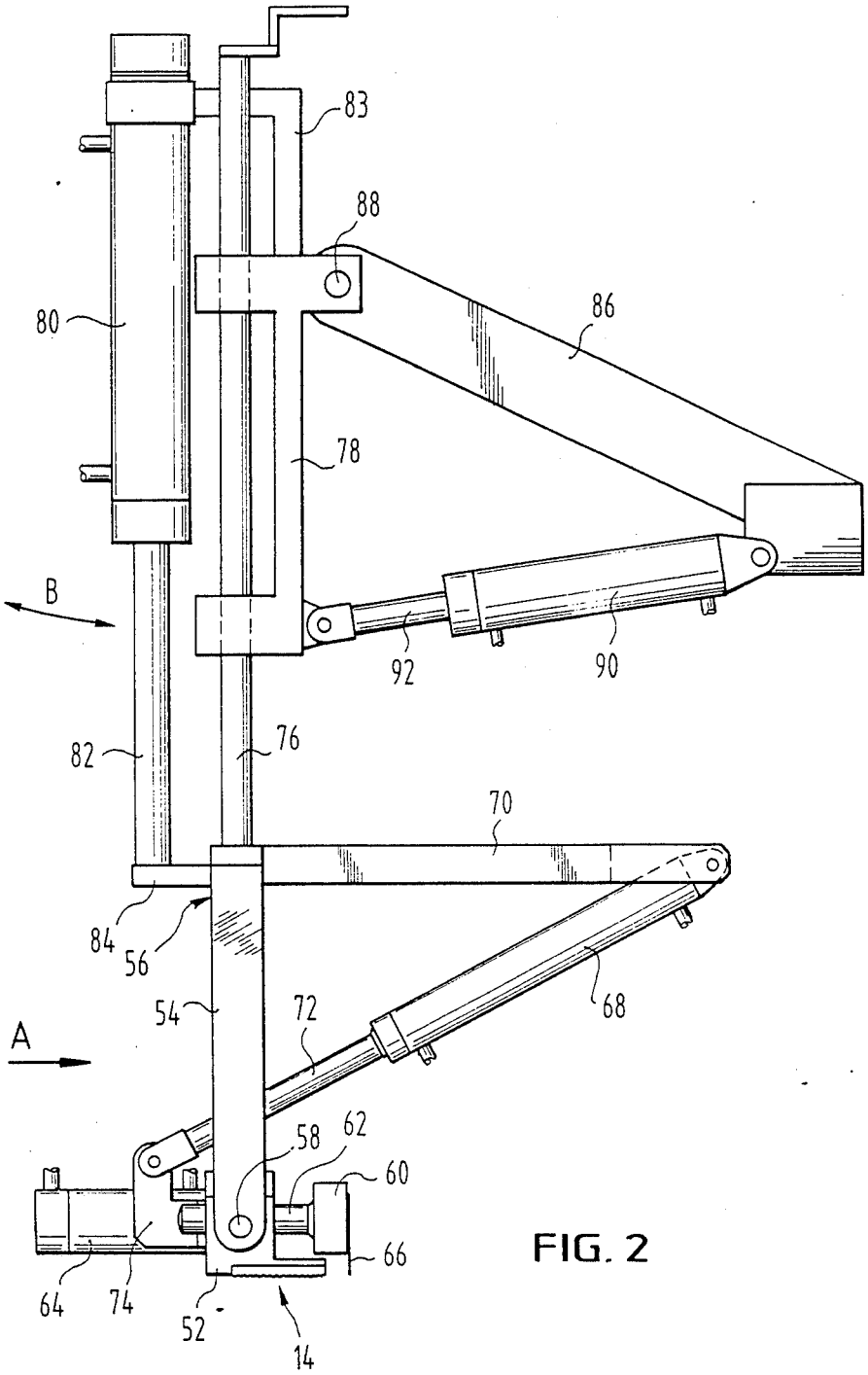
FIG. 2 shows a side-view of the transfer clamp and its adjusting device.
Figure 3:
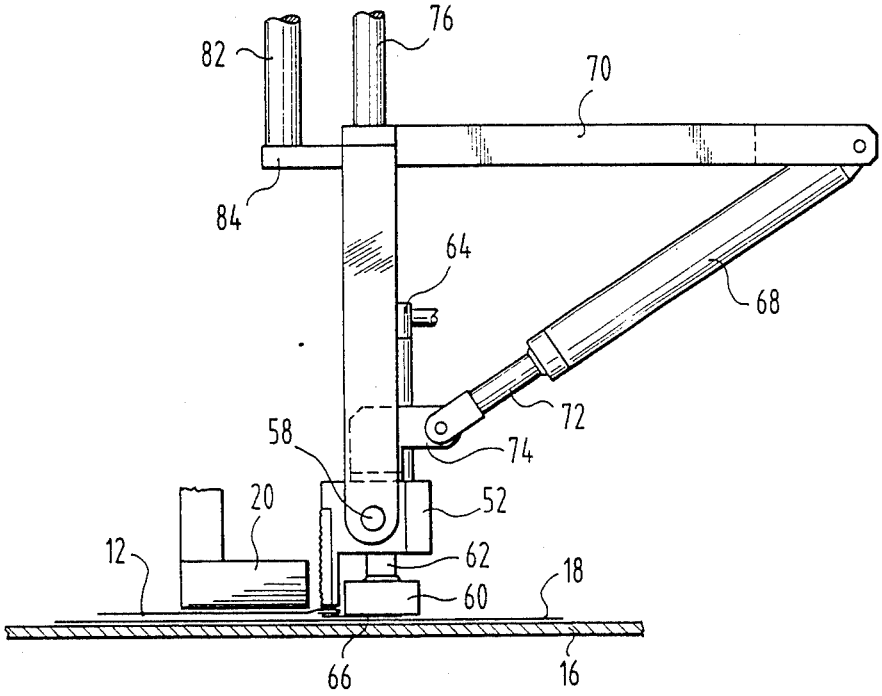
FIG. 3 shows a partial view of the arrangement represented in FIG. 2 with the transfer clamp swung 90 degrees.
Figure 4:
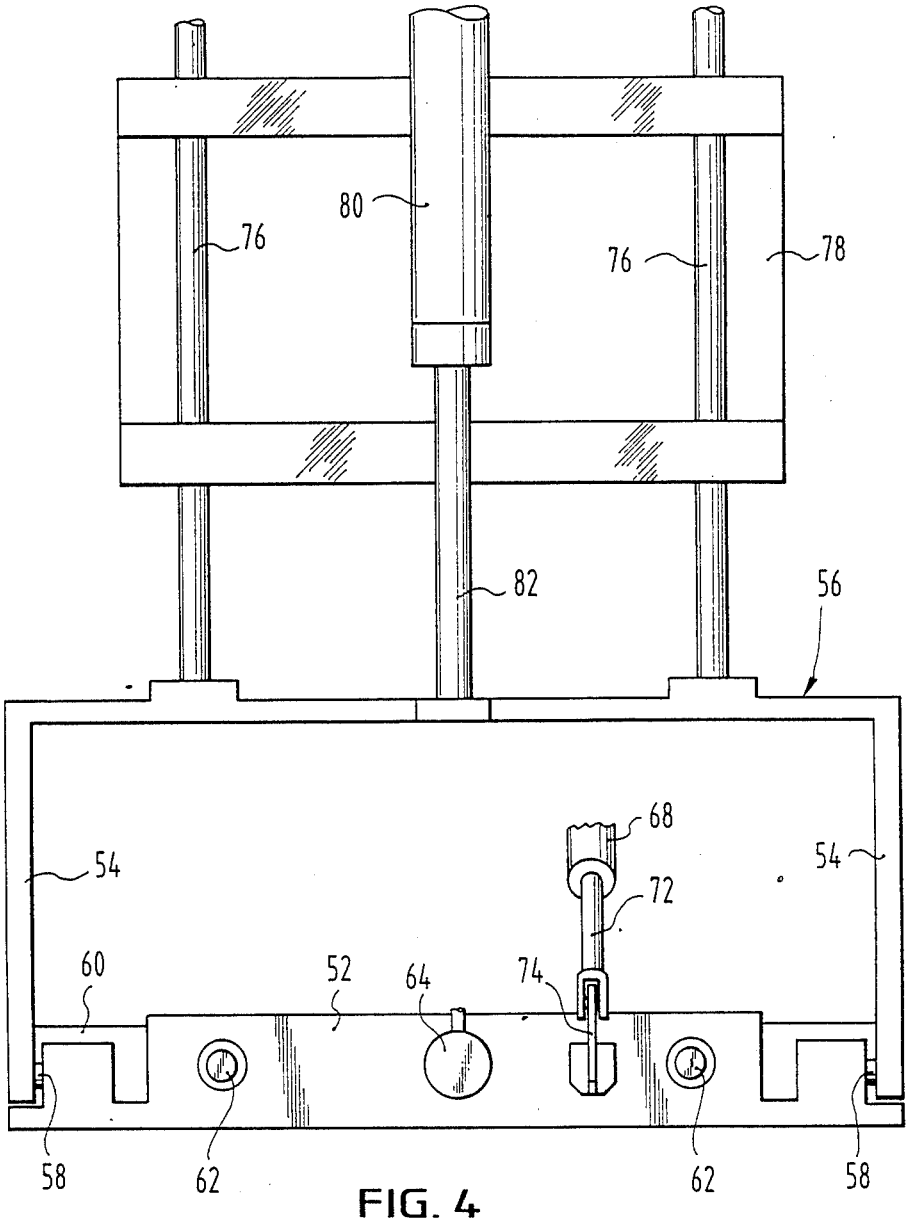
FIG. 4 shows a head-on view of the transfer clamp in the direction of the arrow A in FIG. 2.

The transfer clamp 14 is pivotable on the bow 56, by at least 90 degrees, as shown in the positions of FIGS. 2 and 3. This pivoting action results from a pneumatically operated cylinder 68, which is situated on a cross piece 70. This cross piece 70 is immobily attached to the bow 56. The piston rod 72 of the cylinder 68 approaches the corner piece 74 which is immobily attached to the clamp ledge 52.

The bow 56 is led to the frame 78 (FIG. 2) by a guiding rod 76, in such a way that it may be vertically shifted. The bow 56 is adjustable by a cylinder 80, which is fastened to the frame 78 over a corner piece 83. The piston rod 82 of the cylinder 80 approaches the cam 84, which is immobily fastened to the bow 56. This cylinder 80 is likewise preferably pneumatically operated.

The frame 78 is pivotably mounted on a mount 86 connected to a pivotal axle 88 which is parallel to pivotal axle 58. The frame 78 is adjustable with help of a pneumatically operated cylinder 90. The cylinder 90 is linked onto the mount 86. The piston rod 92 of the cylinder 90 approaches the frame 78. In this way, both the frame 78 and the transfer clamp 14 may be swung at an angle between the vertical position represented in FIG. 2 and the diagonal position seen in FIG. 1. This swing will follow the direction of the double arrow B. This essentially corresponds to the support plate's 24 angle of inclination across from the sewing machine table 16.

The device, thus described until now, operates in the following manner:

To begin with, the laborer lays a fabric piece 18 onto the sewing machine table 16. The laborer then lays a fabric strip 12 onto the support plate 24, so that its one edge lies up against the stop ledge 28. In this way, the fbric strip 12 will be arched upward (as shown in FIG. 1) by the folding bar 34, which projects out over the support plane 40 of the support plate 24. The laborer then operates a switch so that the transfer clamp 14 is swung over the support plate 24 by a cylinder 90. The cylinder 80 then operates to lower the transfer clamp 14 onto the support plate 24, so that it resembles the position represented in FIG. 1. In this position, the folding bar 34 projects (with the arched segment of the fabric strip) into the clamp opening of the fabric clamp 14.

The cylinder 64 is now operated and the clamp ledge 60 moves in the direction towards the clamp ledge 52. This causes the doubled fabric segment and the folding bar 34, which project into the clamping opening, to be clamped. The free moving folding bar 34 (which is not effected by elasticity) then follows the movement of the clamp ledge 60. When the transfer clamp 14 is lifted from the support plate by the operation of cylinder 80, the clamp 14 holds the folded fabric strip 12, while the folding bar 34 slides out from between the clamp ledges 52 and 60.

Operation of the cylinder 68 now causes the transfer clamp 14 to swing clockwise out of the position shown in FIGS. 1 and 2 into the position represented in FIG. 3. Operation of the cylinder 90 then swings the frame 78, together with the transfer clamp 14, into the vertical position shown in FIG. 2. Operation of the cylinder 80 lowers the transfer clamp 14 towards the sewing machine table 16 into the position seen in FIG. 3. Now the clamp ledge 60 with its clamp plate 66 lays on the fabric piece 18. Because the clamp plate 66 is very thin, the fabric strip 12 may be layed practically flat onto the fabric piece 18. Before the transfer clamp is opened, both fabric pieces are clamped against the sewing machine table 16 by the fabric clamp 20. This prevents the folded segment of the fabric strip 12 from becoming unfolded. Now the transfer clamp 14 may be opened. Operation of the cylinder 80 lifts the transfer clamp 14. The fabric clamp 20 then leads the fabric pieces 18 and 12 through under the sewing machine 22. Here, both pieces may be sewn together near the folded edge of the fabric piece 12.

What is claimed is:

1. In a device for transferring a fabric strip from a deposit station to a support base including a transfer clamp for carrying the fabric strip from the deposit station to the support base, the improvement comprising:

a plate 24 having a major surface 40 onto which the fabric strip 12 is placed, an end of the plate 24 having a ledge 28 abutting one end of the fabric strip 12, the plate 24 having an opening 30 therein spaced from the ledge 28;

a folding bar 34 extending upwardly through the opening 30 to raise a portion of the fabric strip 12 above the surface 40;

said transfer clamp 14 having a pair of opposing members 52 and 60 positioned on opposite sides of said folding bar when the transfer clamp is in a receiving position adjacent plate 24; and means for pivoting the transfer clamp about an axis 58 parallel to said members.

2. The improvement of claim 1 wherein one member 52 of the transfer clamp is fixed relative to the other member 60, with the transfer clamp 14 including means 64 for moving the other member 60 towards the member 52 to thereby grasp the fabric strip.

3. The improvement of claim 2 which further comprises:

means for resiliently mounting the folding bar to the plate to permit the folding bar to move with the member along the direction of said major surface when the fabric is being grasped.

4. The improvement of claim 3 which further comprises:

means for adjusting the extent to which the folding bar 34 extends through the opening 30.

5. The improvement of claim 4 wherein the support plate 24 is transparent.

6. The improvement of claim 1 wherein the transfer clamp 14 further comprises:

means for automatically moving the transfer clamp from the deposit station to a support base adjacent a sewing machine.

7. The improvement of claim 6 wherein the transfer clamp further comprises:

means for automatically rotating the transfer clamp so as to bring the member 60 flush with the support base 16.

8. Apparatus for folding and transferring a fabric strip in a folded condition from a deposit station to another piece of fabric lying on a sewing machine table, said apparatus comprising:

a plate 24 having a major surface 40 on which the fabric strip initially rests, the plate 24 having a ledge 28 on an end thereof against which an edge of fabric strip 12 abuts, the plate 24 having an opening 30 therein spaced a given distance from the ledge 28;

a folding bar 34 projecting through the opening 30 for raising the fabric strip 24 from the surface 40; and transfer clamp means 14 for grasping the raised fabric strip 12 and carrying the fabric to the sewing machine table in a folded condition.

9. The apparatus of claim 8 wherein the transfer clamp means includes a pair of relatively moveable members 52, 60 located on opposite sides of the folding bar 34; and means for resiliently mounting the folding bar to permit movement thereof along the surface 40 when the members close to grasp the fabric.

10. The apparatus of claim 9 which further comrpises:

means for tilting the transfer clamp about an axis 58 to permit the folded fabric strip 12 to be laid flush against said another piece of fabric 18 lying on the sewing machine table 16.

11. The apparatus of claim 10 wherein one of said members includes a thin plate 66 that moves against a fixed member 52 to thereby fold and grasp the fabric strip 12.

* * * * *